US005871092A

United States Patent [19]

Rogers et al.

[11] Patent Number: 5,871,092

[45] Date of Patent: Feb. 16, 1999

[54] DISPLAY CONTAINER FOR COLLECTABLE BASEBALL BATS

[75] Inventors: Kenneth D. Rogers, Nacogdoches; Randolph B. Robinson, Lufkin, both of Tex.

[73] Assignee: Sportscube, LC, Cushing, Tex.

[21] Appl. No.: 306,688

[22] Filed: Sep. 15, 1994

[51] Int. Cl.[6] ..... B65D 85/00

[52] U.S. Cl. ..... 206/315.1; 206/769; 211/88; 211/13.1

[58] Field of Search ..... 206/446, 315.1, 206/45.34, 418, 421, 588, 591, 592; 211/88, 13.1; 220/682, 677, 665, 602, 617, 355; 229/125.17, 125.09

[56] References Cited

U.S. PATENT DOCUMENTS

| | | | |
|---|---|---|---|
| 2,607,058 | 7/1952 | Orange | 220/682 X |
| 3,561,982 | 2/1971 | Oeth | 206/45.34 |
| 4,177,934 | 12/1979 | Hammes et al. | 220/355 X |
| 4,380,290 | 4/1983 | Luebke | 206/315.1 |
| 4,890,731 | 1/1990 | Mroz | 206/315.9 |
| 5,082,110 | 1/1992 | Hager | 206/232 |
| 5,165,538 | 11/1992 | Peters | 206/315.9 |
| 5,224,602 | 7/1993 | Bettles et al. | 206/579 |

*Primary Examiner*—Paul T. Sewell

*Attorney, Agent, or Firm*—Cox & Smith Incorporated

[57] ABSTRACT

A case for displaying a collectable bat comprises a hollow tubular element formed by the longitudinal juncture of two semi-tubular elements and secured at both the top and bottom ends by identical end caps defining resilient concave surfaces for respectively engaging the opposite ends of a collectable bat inserted in the display tube.

4 Claims, 3 Drawing Sheets

DISPLAY CONTAINER FOR COLLECTABLE BASEBALL BATS

FIELD OF THE INVENTION

This invention relates to a transparent container for protecting and displaying a collectable bat or a group of collectable bats.

BACKGROUND OF THE INVENTION

The growth of collectors in the United States and other countries, and the number and types of items collected has shown remarkable increase over the past 20 years. One such item that has experienced substantial growth is collectable bats, i.e., bats that are famous because of the fame of the person that used the bat, or because the bat was instrumental in winning a particular ball game or World Series.

Very substantial prices have to be paid for such bats by the ardent collectors and it is always their desire to display their collection of bats, but in a manner that does not permit the deterioration of the surface of the bat by handling, or by repeated insertion or removal from a display holding device. A problem arises when a transparent, elongated container is employed to house a collectable bat in that the container should most desirably permit the insertion of the bat with either end of the bat in the upright position.

Additionally, while it is a fairly easy task to keep the exterior of the transparent container clean to maximize the visibility of the collectable bat, it is very difficult, if not impossible, to effect the proper cleaning of the internal surface of the display container. Thus, an improved transparent readily cleanable container for displaying collectable bats represents an item long needed by bat collectors.

SUMMARY OF THE INVENTION

A display container for collectable bats embodying this invention comprises an elongated tubular element, formed of a clear transparent plastic material such as that sold under the trademark "Lucite™". To minimize the space occupied by the display container, the internal crosssection of the display container should just slightly exceed the maximum diameter of the collectable bat for which it is to be employed.

To permit cleaning of the internal surface of the display container and minimize abrasion of the bat surface through repeated insertions into the tubular display container, the container embodying this invention is preferably formed by two longitudinally splitted half-elements having abutting longitudinal edges which are secured together by tongue and groove elements respectively formed on the edges of the two half elements.

To further secure the bat within the container and protect it from rattling against the internal walls of the display container during shipment, a pair of identical end caps or closures are provided for each end of the tubular container. The end cap or closure defines a peripherally extending flange which is sized so as to frictionally engage the internal peripheral end surfaces of the assembled half tube elements.

Additionally, the internal medial portion of each end cap defines a concave surface that resiliently engages the end surface of an inserted bat, regardless of the direction of insertion of the bat. Obviously, the end caps are formed from a suitable resilient moldable material such as polyethylene or polypropylene.

The display apparatus embodying this invention may have a variety of cross-sections, such as rectangular, cylindrical, hexagonal, etc., but preferably comprises a square cross-section with the edges of the two longitudinal half elements forming the two opposed vertices of the square cross-section. This puts the junction grooves in two of the corners of the display tube and minimizes the obstruction of the viewing area of the display tube.

In accordance with another preferred feature of this invention, each cap or closure element is provided on with an externally projecting mounting tab and, transversely disposed relative to the mounting tab, with a groove dimensioned to snugly receive the mounting tab of an, adjacent display container. This permits a plurality of display containers to be secured together in parallel adjacent relationship, thus minimizing the space required for the display of a plurality of collectable bats.

Other advantages of the invention will be readily apparent to those skilled in the art from the following detailed description taken in conjunction with the annexed sheets of drawings, on which is shown a preferred embodiment of the invention.

DESCRIPTION OF THE PREFERRED EMBODIMENT

Figure 1:
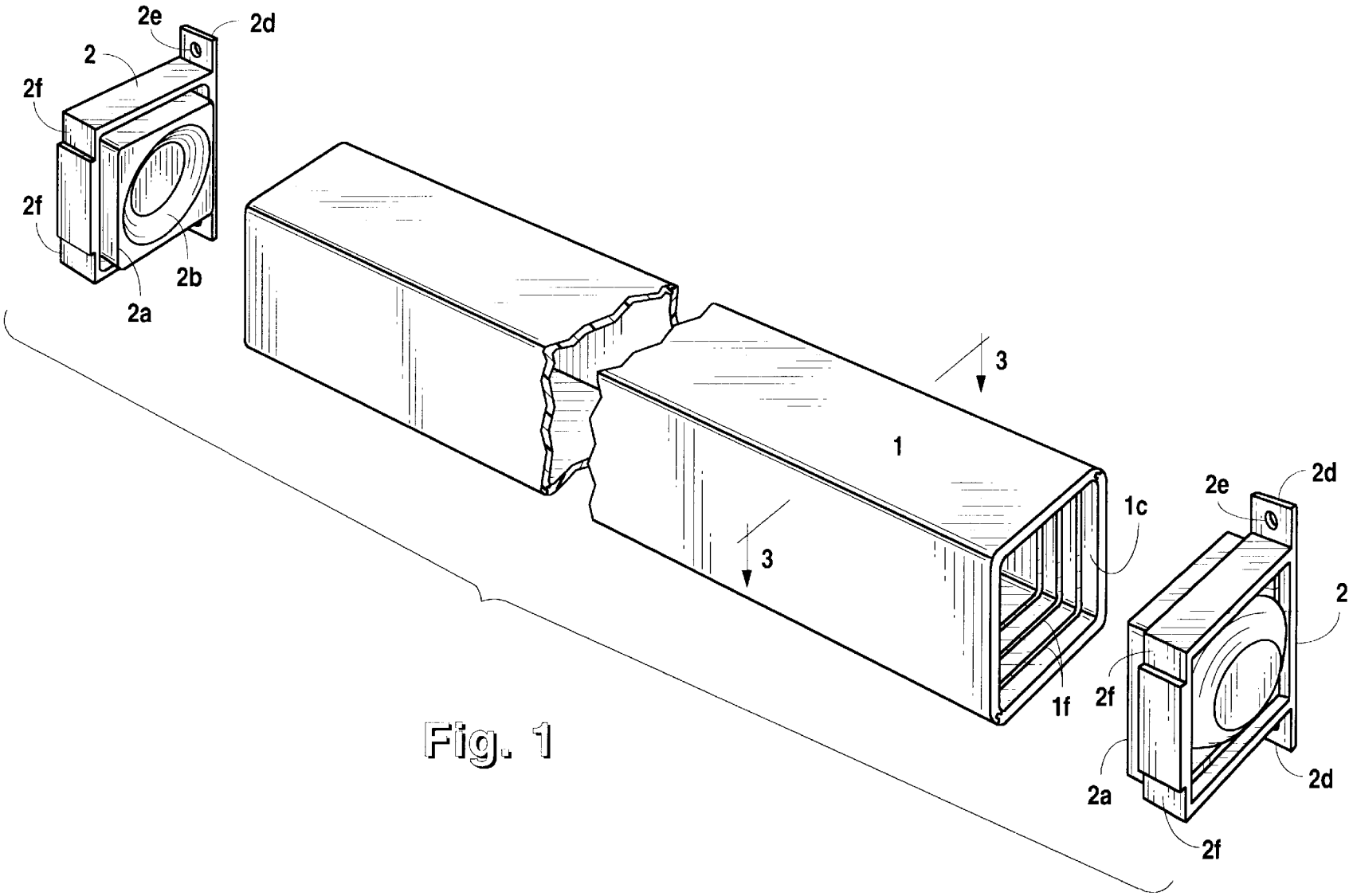
FIG. 1 is an exploded perspective view showing the three elements of a bat display case embodying this invention.
Figure 2:
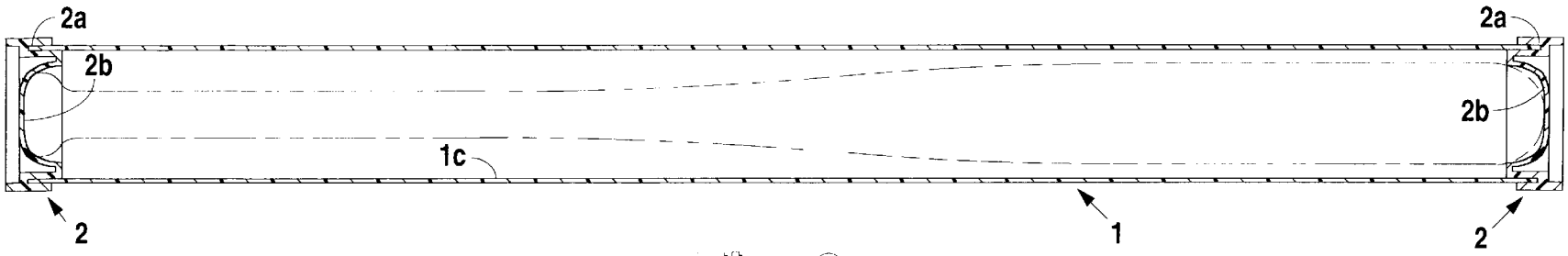
FIG. 2 is a longitudinal sectional view of a bat display case embodying this invention with the configuration of a bat inserted in the display case indicated by dotted lines.

Referring to the drawings, a bat display case embodying this invention, comprises a elongated tubular display element 1 having a generally square or rectangular cross section and being formed of a transparent rigid plastic material such as that sold under the trademark "Lucite™", so that a collectable bat inserted within the internal bore 1*c* of the tubular display case element 1 wlll be clearly visible through the walls of the display case. The length of the display element is substantially equal to the length of the collectable bat to be inserted therein, and the cross-sectional area freely accommodates the particular collectable bat.

A pair of identical end elements or closures 2 are provided for each display case and have a rectangular configuration slightly larger than that of the tubular element 1 and defining a rectangular perimetrical flange 2*a*which fits snugly within the peripheral surfaces of either end of the main tubular element 1, thus providing a dust proof enclosure for the collectable bat. Ends 2 are preferably formed by molding of a resilient plastic material, such as high density polyethylene, polypropylene, or the like. Each end element 2 further defines a concave surface 2*b* which is configured to engage either end of the collectable bat to prevent any significant longitudinal or axial movement of the bat relative to the display case.

In the preferred embodiment of this invention, the interior surface of each end of the display case element 1 is provided with a plurality of longitudinally spaced small ridges 1*f* on the order of 0.005' wide and 0.005' high. These ridges serve two functions. First, they securely engage the interior walls of the end cap or closure 2. Secondly, they provide guide lines for sawing to reduce the length of display case element 1, if the particular collectable bat is shorter than the length of the display case.

Figure 3:
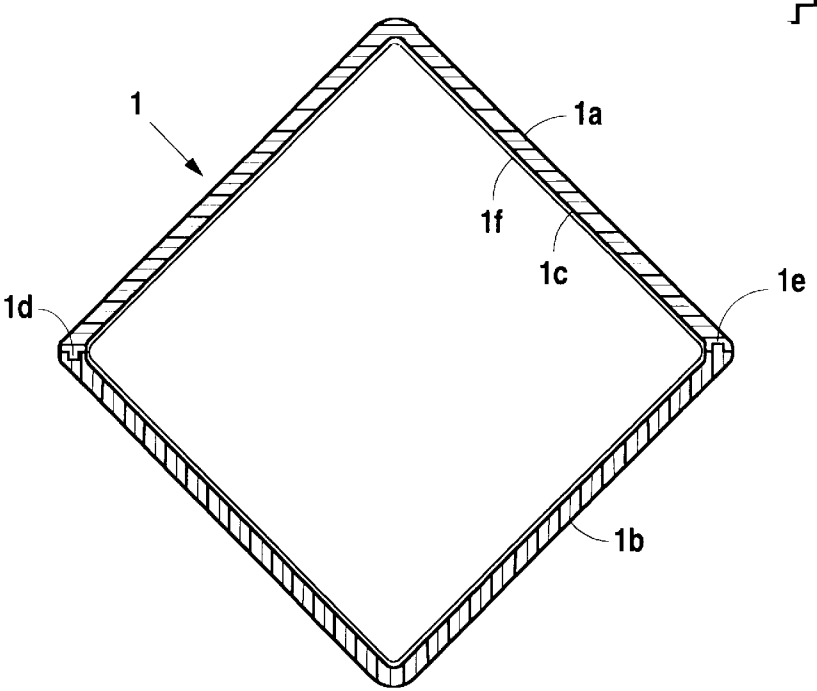
FIG. 3 is an enlarged scale sectional view of the display case of FIG. 1 taken on the plane 3—3 of FIG. 1.
Figure 4:
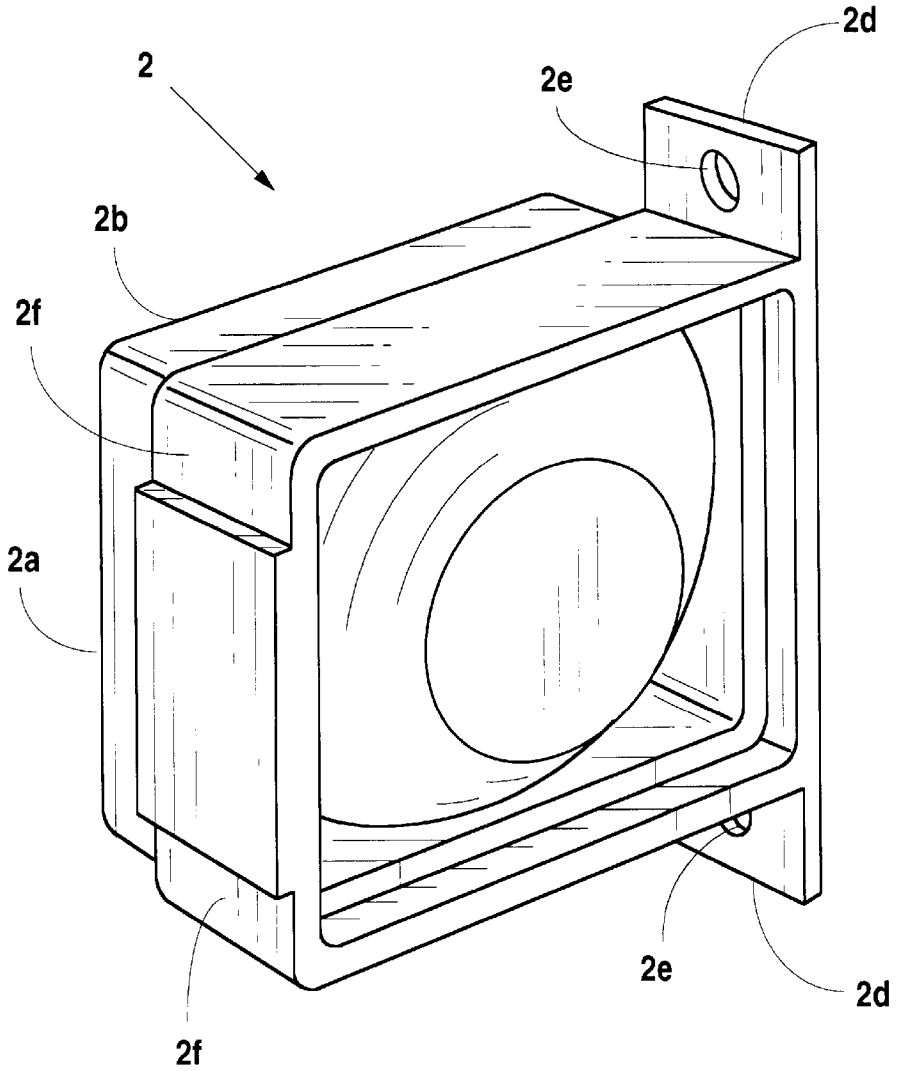
FIG. 4 is an enlarged scale, perspective view of an end or closure element of the display case.

Referring to FIG. 3, the tubular element 1 is shown as being preferably formed of two identical right angle longitudinal elements 1 *b* and 1*b* having a slot 1*d* in one longitudinal end surface and a tongue 1*e* on the opposite longitudinal surface, so that the two right angle elements 1*a* and 1*b* may be snapped into engagement by inter-engaging each tongue 1*e* into a cooperating slot 1*d*.

The formation of the main tubular display element 1 as an assemblage of two elongated parts is particularly desirable in that it permits the convenient cleaning of the internal surfaces of the main tubular element 1, thus ensuring the utmost visibility for any collectable bat disposed within the interior of the main tubular display element 1.

As shown in FIG. 1, each end element 2 is provided with two opposed projecting tangs 2*d* having a transverse hole 2*e* formed therein. Such mounting tangs may be secured to any planar surface to provide a permanent mounting of a particular display case.

Figure 5:
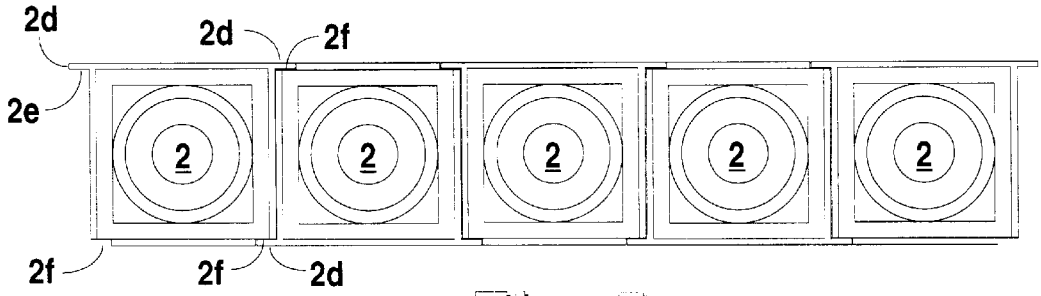
FIG. 5 is a top elevational view illustrating the illustrating the assemblage of a plurality of display cases to form a unitary mounting unit.

In the event that is it desired to mount a plurality of equal length collectable bats in adjacent relationship on a display board, the end pieces 2 are additionally provided with two recesses 2*f* respectively opposite the projecting tangs 2*d* and shaped to snugly receive a projecting tang 2*d* of an adjacent display element in the manner indicated in FIG. 5. Thus, a plurality of display elements 1, each containing a collectable bat may be assembled in side-by-side adjacent relationship and mounted by the projecting tangs ld respectively provided on the two ends most display cases by screws (not shown) traversing the holes 2*e* formed in the projecting tangs 2*d*.

The advantages of the display case embodying this invention will be readily apparent to those skilled in the art from the foregoing description. The collectable bat is displayed in its entirety in a dust-proof protective environment, yet can be quickly removed from the display case for physical handling, whenever that is desired.

Modifications of this invention will be readily apparent to those skilled in the art and it is intended to incorporate all such modifications falling within the scope of the appended claims.

We claim:

1. Apparatus for displaying a collectable baseball bat comprising:

an elongated transparent tube l)aving an internal surface greater in cross-section than any portion of thp colletable baseball bat, whereby the collectible baseball bat may be inserted in said tube with either end of the collectible baseball bat foremost;

the length of said tube exceeding the length of the collectible baseball bat;

a pair of identical closures formed of a resilient plastic material;

each closure defining a peripheral flange constructed and arranged to ,snugly engage within either end of aid tube;

each closure having an internally projecting flange portion defining a concave surface resiliently adapted to engage the adjacent end of the collectible baseball bat when inserted in said tube whereby the collectible baseball bat is resiliently supported between said concave surfaces when both said closures are respectively upwind to the ends of said tube.

2. Apparatus for displaying a collectible baseball bat comprising:

an elongated transparent tube having an internal surface greater in cross section than any portion of the collectable baseball bat, whereby the collectible baseball bat may be inserted in said tube with either end of the collectible baseball bat foremost;

the length of said tube exceeding the length of the collectible baseball bat;

a pair of identical closures formed of a resilient plastic material;

each closure defining a peripheral flange constructed and arraigned to snugly engage either end of said tube:

each closure having an internally protecting flange portion defining a concave surface resiliently engagable with the adjacnt and of the collectible baseball when inserted in said tube, whereby the collectible baseball bat is resiliently supported between said concave surfaces when both said closures are respectively applied to the ends of said tube;

said tube having a square cross section and formed by the longitudinal junction of two identical longitudinal half sections;

each said longitudinal half section having two longitudinal edges;

one of said longitudinal edges defining a longitudinal groove; and the other said longitudinal edge having an elongated tongue snugly insertable in said longitudinal groove.

3. The apparatus of claim 1 wherein each end of said tube is provided with a plurality of longitudinally spaced peripheral ridges to snugly engage said peripheral flange of an applied end cap.

4. Apparatus for displaying a collectible baseball bat comprising:

an elongated transparent tube having an internal surface greater in cross-section than any portion of the collectible baseball hat whereby the collectible baseball bat may be inserted in said tube with either end of the collectible baseball bat foremost;

the length of said tube cxceeding the length of the collect baseball bat:

a pair of identical closures formed of a resilient plastic material:

each said closure having a pair of externally projecting, transversely spaced aligned mounting tabs, and a pair of transversely spaced, aligned recesses respectively disposed opposite said mounting tabs, each said recess being shaped to snugly receive a mounting tab of the closure of an adjacent collectible baseball bat display apparatus mounting tabs.

* * * * *